United States Patent [19]

Jones

[11] Patent Number: 5,005,292

[45] Date of Patent: Apr. 9, 1991

[54] SWIVEL GRIP ARRANGEMENT FOR KNIVES

[76] Inventor: Gerald L. Jones, 2130 Deauville Rd., Richmond, Va. 23235

[21] Appl. No.: 514,451

[22] Filed: Apr. 25, 1990

Related U.S. Application Data

[63] Continuation-in-part of Ser. No. 310,579, Mar. 23, 1989, Pat. No. 4,920,648.

[51] Int. Cl.[5] ..... B26B 27/00; B26B 29/00; B26B 13/00

[52] U.S. Cl. ..... 30/298; 30/232; 30/291

[58] Field of Search ..... 30/298, 291, 232, 153; 7/148, 158

[56] References Cited

U.S. PATENT DOCUMENTS

| | | | |
|---|---|---|---|
| 1,442,827 | 1/1923 | Richardson | 30/298 |
| 1,879,851 | 9/1932 | Kravitz | 30/298 |
| 4,542,585 | 9/1985 | Ito et al. | 30/298 |
| 4,817,221 | 4/1989 | Ryan | 30/298 |

*Primary Examiner*—Douglas D. Watts
*Assistant Examiner*—Paul M. Heyrana, Jr.
*Attorney, Agent, or Firm*—Henderson & Sturm

[57] ABSTRACT

A detachable swivel grip arrangement (10) for knives (100) wherein the grip arrangement (10) includes a grip unit (11) an axle unit (12) and a detachable axle capturing unit (13) operatively connected with one another and releasably associated with the knife handle (102) to allow both reciprocating and rotating movement of the grip arrangement (10) relative to the knife (100) when the swivel grip arrangement is operatively displayed relative to the knife (100).

6 Claims, 2 Drawing Sheets

FIG. 1.
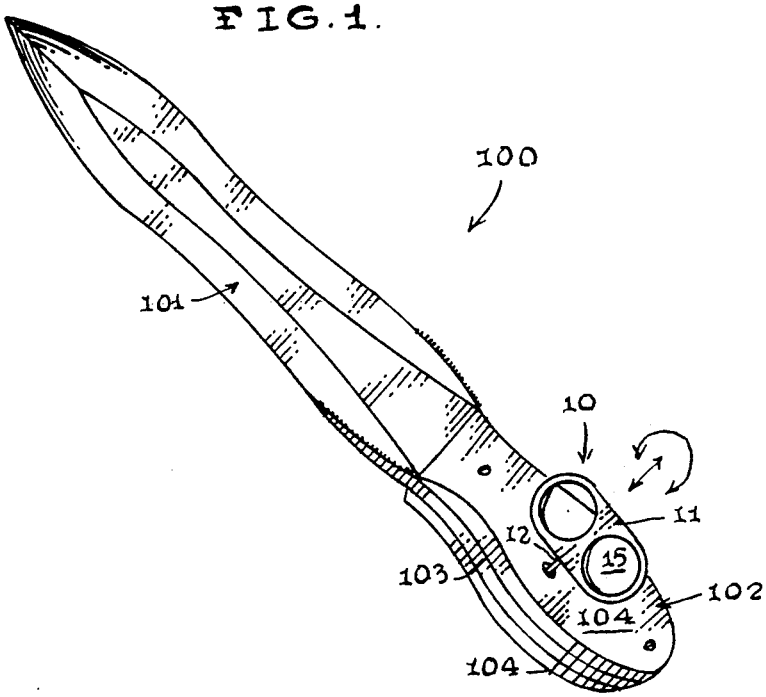
FIG. 2.
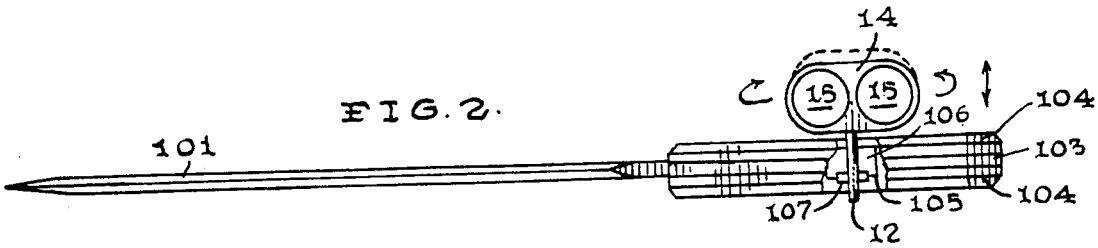
FIG. 3.
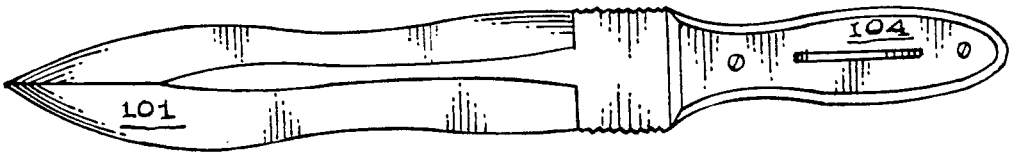
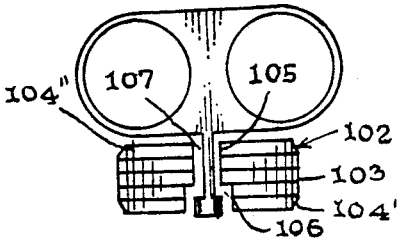
FIG. 4.
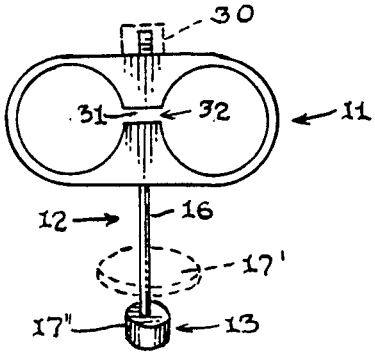
FIG. 5.

SWIVEL GRIP ARRANGEMENT FOR KNIVES

BACKGROUND OF THE INVENTION

This is a continuation in part of my co-pending patent application Ser. No. 07,310,579 which was filed on Mar. 23, 1989, now U.S. Pat. No. 4,920,648, 5/1/90 and is entitled SWIVEL ARRANGEMENT FOR KNIVES.

TECHNICAL FIELD

This invention relates in general to an attachment for knives, and in particular to a detachable swivel grip attachment for knives which allows the handle of a knife to be operatively engaged by the users hand allowing rotational movement of the knife blade from one position to another.

As can be seen by reference to the following U.S. Pat. No's: 4,087,911; 4,283,854; 4,034,982; and 2,359,098 the prior art is replete with myriad and diverse hand-held weapon arrangements.

While the prior art constructions are more than adequate for the broad purpose and function for which they were specifically designed, they also fall far short of providing the ideal combat weapon, particularly with respect to the rapid reorientation of the weapon.

For instance, all the prior art devices comprise simple finger receiving grip appendages which insure the basic retention of the related knife construction; however, these devices do not allow for retention of the knife during a maneuver to reorient the knife. This rapid reorientation in a combat situation such as from a defensive position into an attack position, can be of vital importance, and will in most instances involve the life or death of one of the combatants.

Furthermore, most common knife constructions do not provide for one handed reorientation. Typically, a soldier in combat would either: haphazardly rotate the knife using only one hand, and risk dropping the weapon entirely, or being disarmed by the attacker during the attempted rotation; or, would use both hands to rotate the knife, thereby putting himself at a decided disadvantage during this action as a consequence of this complicated maneuver.

Obviously, there has existed a longstanding need for an improved knife construction which incorporates security, adjustability,. and adaptability; and the development of such a device is the stated purpose and objective of the present invention. Furthermore there is also a pressing need among chefs, homemakers, and hunters for a knife that would have a swivel grip capability particularly if the swivel arrangement could be detachably mounted on the knife handle to permit the selective deployment of the swivel grip arrangement relative to the knife.

SUMMARY OF THE INVENTION

Briefly stated, the knife swivel grip arrangement that forms the basis of the present invention comprises in general: a grip unit, an axle unit and a releasable axle capture unit which are operably engaged with one another and movably associated with the handle of a knife.

In essence the primary objective behind the development of the knife swivel grip arrangement of this invention is to provide the user with a safe, efficient, and foolproof means of maintaining a grasp on a knife as the user reorients the knife from a blade up to a blade down grip.

To that end the handle portion of a knife is provided with a centrally located slipped aperture which extends through both sides of the knife handle.

The grip unit comprises in general: an oblong grip member having a plurality of finger holes formed therein; wherein, in the preferred embodiment of the invention the grip member is further provided with an adjustment mechanism whereby the dimensions of the finger holes can be varied to provide a custom fit for individuals having different sized hands. It should further be noted that this adjustment feature is particularly useful for both men and women having smaller than normal fingers.

The axle unit comprises an elongated axle member having an axial length which is greater than the thickness of the knife handle wherein one end of the axle member is operatively engaged by the axle capturing unit.

The axle capturing unit comprises a capturing member which is rigidly secured to and projects radially outwardly from the periphery of the axle member; wherein, the axle is dimensioned to be slideably received in the slipped aperture of the knife handle; and, wherein the capturing member is dimensioned such that it cannot pass through the smaller diameter portions of the slipped aperture.

As will be explained in greater detail further on in the specification the basic arrangement thus far described provides an improved gripping means for knives that will allow the user to quickly and securely pivot the knife blade relative to the grip means from either a blade up or a blade down orientation relative to the users hand.

BRIEF DESCRIPTION OF THE DRAWINGS

These and other objects advantages and novel features of the invention will become apparent from the detailed description of the best mode for carrying out the preferred embodiment of the invention which follows; particularly when considered in conjunction with the accompanying drawings, wherein:

FIG. 1 is a perspective view of the swivel grip arrangement employed on a combat knife;

FIG. 2 is a cross-sectional side view of one version of the axle capturing unit and knife handle slipped recess;

FIG. 3 is a top plan view of the swivel grip arrangement arrangement employed on a knife;

FIG. 4 is a cross-sectional end view of another version of the axle capturing unit and knife handle slipped recess;

FIG. 5 is an isolated view of the grip arrangement equipped with the grip unit adjustment mechanism;

BEST MODE FOR CARRYING OUT THE INVENTION

Figure 6:
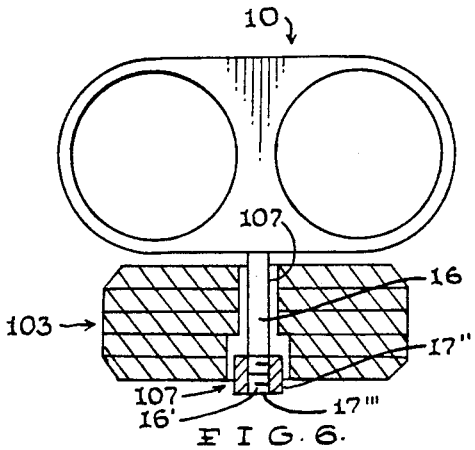
FIG. 6 is an enlarged cross-sectional view of one form of the detachable version of this invention.

As can be seen by reference to the drawings and in particular by reference to FIG. 2, the grip arrangement that forms the basis of the present invention is designated generally by the reference numeral (10). The grip arrangement (10) comprises in general: a finger grip unit (11); an axle unit (12); and, an axle capturing unit (13) which are operatively connected to one another and operatively engaged with a conventional knife (100). These various structural components will now be described in seriatim fashion.

As can best be seen by reference to FIGS. 2 thru 4, the knife construction (100) comprises a knife blade (101) that is operatively engaged with a knife handle member (102) wherein the stem (103) of the knife blade (101) is sandwiched between two opposed hand grip members (104) which are operatively secured to one another and operatively engaged with the knife blade stem (103) by a plurality of suitable fastening means (105) such as brads, or the like, which extend through discrete apertures (not shown) formed in the stem (103) and the hand grip members (104) in a well recognized fashion.

As shown in FIGS. 2, 4 and 5, the finger grip unit (11) generally comprises an oblong finger grip member (14) having a plurality of finger holes (15) formed therein. In addition, the axle unit (12) comprises an elongated axle member (16) operatively attached on its upper portion to the grip member (14); wherein, the axle capturing unit (13) is operatively engaged with the periphery of the axle member (16) at a location spaced from the operative connection between the grip member (14) and the axle member (16); and wherein the length of the axle member (16) is greater than the thickness "" of the knife handle (102).

The axle capturing unit (13) comprises in general: a capture member (17) which is secured to, and radially projects outwardly from, the periphery of the lower portion of the elongated axle member (16).

As mentioned previously, knife handle member (102) is provided with a stepped aperture designated generally as (105) wherein the stepped aperture (105) is provided with an enlarged diameter bore (106) which is dimensioned to accommodate both the axle member (16) and the capture member (17); and, at least one reduced diameter bore (107) which is dimensioned to only accommodate the axle member (16).

In the one version of the capturing unit (13) depicted in FIG. 2, the stepped aperture (105) comprises an enlarged diameter bore (106) formed at least in the knife blade stem (103) and aligned reduced diameter bores (107) formed in the hand grip members (104); wherein the capturing member (17) consists of a flat disk element (17') which is spaced from the lower end of the axle member (16). In this particular version the capturing member (17) is itself held captive intermediate the hand grip members (104) while allowing the finger grip member (14) to reciprocate and rotate relative to the knife handle (102).

In the other version of the capturing unit (13) depicted in FIG. 4, the stepped aperture (105) comprises an enlarged diameter bore (106) formed in the lower hand grip member (104') and optionally formed through at least a portion of the knife handle stem (103); and a reduced diameter aligned bore (107) formed in the upper hand grip member (104'); wherein, the capture member (17) consists of an enlarged cylindrical element (17") disposed on the lower end of the axle member (16). In this particular version the enlarged cylindrical element (17") is dimensioned to be loosely received in the enlarged cylindrical bore (106); such that the finger grip member (14) may reciprocate and rotate relative to the upper hand grip member (104").

At this juncture it should be emphasized that not only does the present arrangement (10) allow the knife (100) to be rotated relative to the users hand (not shown); but, this arrangement (10) further facilitates the rotary reorientation of the knife (100) by providing a limited amount of lateral displacement between the knife (100) and the users hand due to the reciprocating movement of the axle capturing unit (13) relative to the knife handle (102). It should further be noted that the finger grip member (14) also serves as a finger/knuckle guard that will deflect slashing knife thrusts that either come in contact with or pass closely along the outside surface of the knife (100) particularly in the blade up orientation.

Turning now to FIG. 5, it can be seen that the adjustment mechanism (30) that is contemplated for use with the finger grip member (14) to vary the size of the finger holes (15) comprises a modification to both the finger grip member (14) and the axle member (16). In order to produce the adjustment mechanism (30) it will be necessary to form a central vertically disposed aperture (31) through the middle of the finger grip member (14) wherein at least the upper portion of the aperture (31) is provided with threads. In addition an opening (32) must be created between the finger holes (15) adjacent the aperture (31); and the upper portion of the axle member (14) must be threadedly engaged with upper portion of the finger guard member (14) while being both rotatably and captively connected to the lower portion of the finger guard member (14).

Once the aforementioned modifications have been made rotation of the axle member (16) in one direction relative to the bottom portion of the finger guard and a counterrotation of the axle member (16) relative to the bottom portion of the finger guard member (14) will cause the finger openings (15) to expand and a counterrotation of the axle member (16) relative to the bottom portion of the finger guard member (14) will cause the finger openings (15) to contract.

Turning now to FIG. 6 it can be seen that in the first detachable version of the swivel arrangement (10) the detachable capture member (17) consists of an enlarged cylindrical captive element (17") provided with a threaded aperture (17"') which is dimensioned to receive the threaded periphery of the lower portion (16') of the elongated axle member (16) in a well recognized manner.

In this particular version the threaded lower portion (16') of the axle member (16) is inserted through the reduced diameter bore (107) on one side of the knife handle stem (103) and then the enlarged cylindrical capture element (17") is inserted into the enlarged cylindrical bore (106) on the opposite side of the knife handle stem (103) to threadedly engage the elongated axle member (16).

Figure 7:
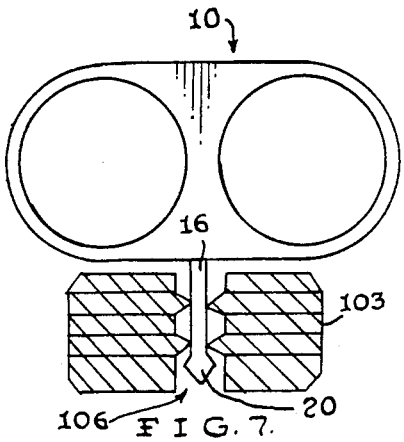
FIG. 7 is an enlarged detail view of another form of the detachable version; and, FIG. 8 is an exploded cross-sectional detail view of the detachable version depicted in FIG. 7.
Figure 8:
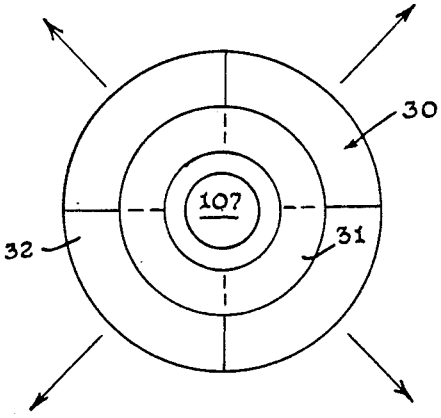
Figure 9:
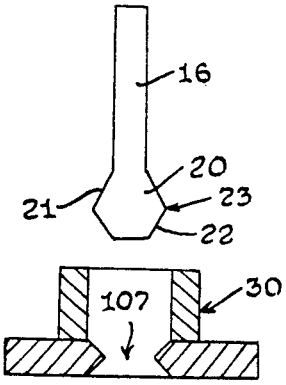

In the second detachable version of the swivel arrangement (10) depicted in FIGS. 7 through 9, the detachable capture member (17) comprises a plastically deformable tapered stud element (20) which is operatively attached to the lower portion of the elongated axle member (16). The study element (20) has inwardly tapered ends (21)(22) and an enlarged intermediate section (23), whose diameter is slightly greater than the reduced diameter bore (107); wherein, the intermediate section (23) of the deformable stud must be plastically deformed as it is forced through the reduced diameter bore (107).

Then once the intermediate section (23) enters the enlarged cylindrical bore (106) the plastic memory of the deformable stud element (20) will be restored to releasably yet captively engage the capture member (17) relative to the enlarged diameter bore (106). In addition both the upper and lower ends (21)(22) of the collar (20) are tapered to facilitate the insertion and removal of the capture member (17) relative to the enlarged diameter bore (106).

In addition, as can be seen particularly be reference to FIGS. 8 and 9 this invention further contemplates the use of a non-deformable study element (20) in conjunction with an expansible collar element (30) which is disposed within the knife handle (103); wherein, the expansible collar element (30) has an integrally formed reduced diameter bore (107). In this particular embodiment the collar element (30) is provided with a segmented stem (31) and disk (32) portions which are adapted to expand in a radial direction to releasably accommodate the passage of the non-deformable study element (20) in a well recognized fashion.

It should further be noted that in the event that it is desirous to provide for the lateral adjustability of the swivel arrangement (10) relative to the knife handle (103), the intermediate portion of the enlarged cylindrical bore (106) may be provided with an auxiliary reduced diameter bore (107) (shown in phantom) forming at least two chambers which are dimensioned to receive the deformable collar element (20) at different levels of penetration relative to the knife handle (103).

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A swivel grip arrangement in combination with a knife including a knife blade having a blade stem and a knife handle having hand grip members disposed on opposite sides of the blade stem wherein the arrangement comprises:

a finger grip unit including a finger grip member having a plurality of finger holes;

an axle unit comprising an elongated axle member operatively engaged with said finger grip member; and, an axle capturing ,unit comprising a detachable capture member which is easily detachable by hand and which radially projects from, and is secured to, the periphery of the elongated axle member; wherein, the finger grip unit is disposed on one side of the knife handle; the axle member projects through at least one of the hand grip members on said one side of the knife handle; and, the detachable capture member is disposed on the opposite side of said at least one handle grip member; whereby the finger grip member is capable of at least rotary movement relative to said knife; and, wherein the detachable capture member permits the swivel grip arrangement to be selectively engaged with the knife handle.

2. The swivel grip arrangement as in claim 1 wherein the axle member is provided with a lower threaded portion and the detachable capture member is provided with a threaded aperture for threaded engagement and disengagement relative to the said axle member.

3. The swivel grip arrangement as in claim 1 wherein the knife is provided with a stepped recess formed in said handle grip members and said knife blade stem and comprises an enlarged diameter bore and at least one reduced diameter bore formed in the handle grip member.

4. The swivel grip arrangement as in claim 3; wherein, the detachable capture member comprises:

a stud element operatively secured to the elongated axle member wherein the diameter of the collar element is slightly larger than the diameter of the reduced diameter bore.

5. The swivel arrangement as in claim 4 wherein the stud element is capable of plastic deformation and the upper and lower ends of the collar element are inwardly tapered.

6. The swivel grip arrangement as in claim 4; wherein the capture member further comprises:

an expansible collar element operatively disposed within the knife handle; wherein, the expansible collar element is provided with said reduced diameter bore.

* * * * *